US005334058A

United States Patent [19]

Hotea

[11] Patent Number: 5,334,058

[45] Date of Patent: Aug. 2, 1994

[54] ELECTRICAL SOCKET TERMINAL

[75] Inventor: Gheorghe Hotea, Griesheim, Fed. Rep. of Germany

[73] Assignee: The Whitaker Corporation, Wilmington, Del.

[21] Appl. No.: 142,851

[22] Filed: Oct. 25, 1993

[30] Foreign Application Priority Data

Dec. 1, 1992 [GB] United Kingdom ..... 9225136

[51] Int. Cl.[5] ..... H01R 4/48

[52] U.S. Cl. ..... 439/839; 439/851

[58] Field of Search ..... 439/833, 839, 842, 843, 439/851-856, 861, 862, 874

[56] References Cited

U.S. PATENT DOCUMENTS 4,040,713 8/1977 Konnemann ..... 439/839
4,919,628 4/1990 Mobley et al. ..... 439/852
5,035,654 7/1991 Endo ..... 439/679
5,246,390 9/1993 Egenolf ..... 439/839

FOREIGN PATENT DOCUMENTS 0361010 7/1989 European Pat. Off. .
3502633 1/1985 Fed. Rep. of Germany .

*Primary Examiner*—David L. Pirlot
*Attorney, Agent, or Firm*—Eric J. Groen

[57] ABSTRACT

An electrical contact is shown including a front contact section and a wire terminating section. An outer spring surrounds the front mating contact portion and includes side walls and top wall portions including tabs which form a central polarizing rib as well as retain the outer spring portion together. The contact also includes an integral wire terminating slot section formed from side walls of the inner contact and include a wire terminating slot at for receiving the wire of a suppression device.

4 Claims, 4 Drawing Sheets

ELECTRICAL SOCKET TERMINAL

BACKGROUND OF THE INVENTION

1. Field of the Invention

This invention relates to an electrical socket which is matable with a pin.

2. Description of the Prior Art

There is shown in WO 89/05531, a socket for mating with an electrical pin, where the socket has contact arms for contact with a pin, and an outer spring portion surrounding the contact, where the outer spring portion carries a polarizing rib, as well as a locking lance.

SUMMARY OF THE INVENTION

It is an object of the present invention to provide such a contact structure where the overall profile of the electrical terminal is more compact, increasing the density of the electrical system.

The objects of the invention were accomplished by providing an electrical terminal comprising a mating contact portion and a wire terminating rear section, and an outer spring in surrounding relation to the mating contact section. The terminal is characterized in that the outer spring is box shaped including a base wall, two side walls and top wall portions folded over to form a longitudinal seam, the top wall portions including at least one upstanding tab extending from each seam in abutting relation and fixed to opposite sides of the other thereby forming a central polarizing feature.

DETAILED DESCRIPTION OF THE PREFERRED EMBODIMENT

Figure 1:
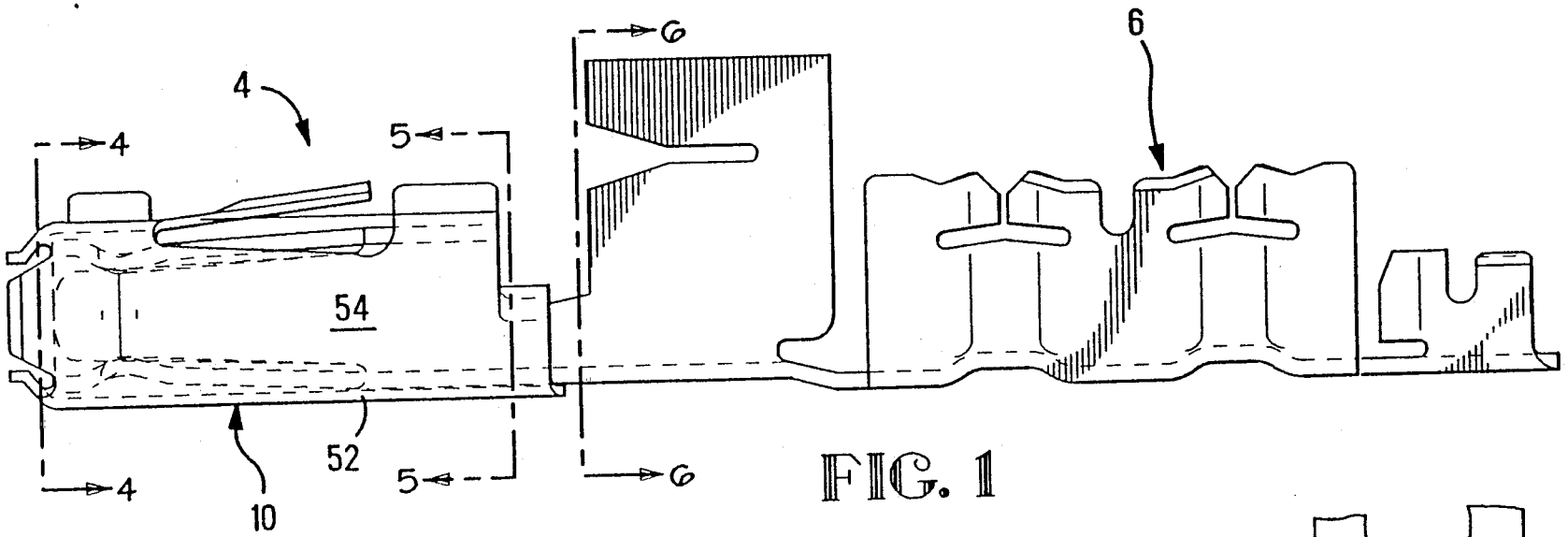
FIG. 1 is a side view of the assembled electrical contact.

With reference first to FIG. 1, an electrical terminal is shown generally at 2 including a front contacting section 4 and a wire terminating section 6. As shown best in FIG. 3, the front mating contact section is shown as a box shaped receptacle at 8 having an overlying outer spring 10 (FIG. 1) in surrounding relationship.

Figure 3:
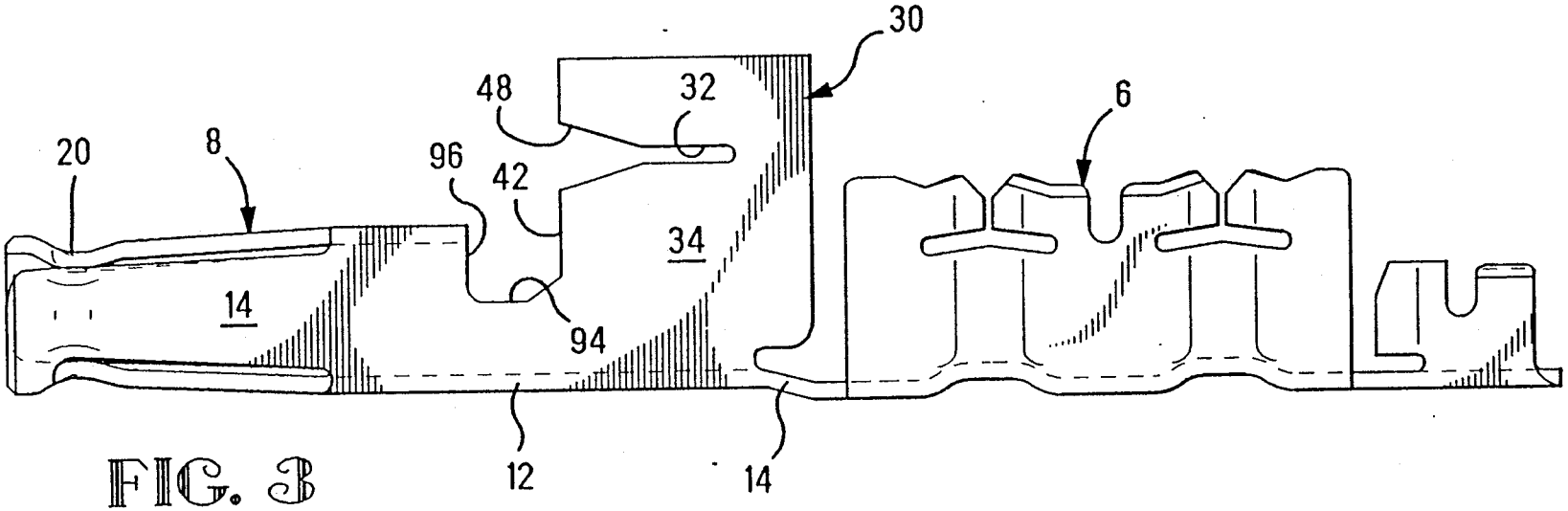
FIG. 3 is a side view similar to that of FIG. 1 without the outer spring attached.
Figure 5:
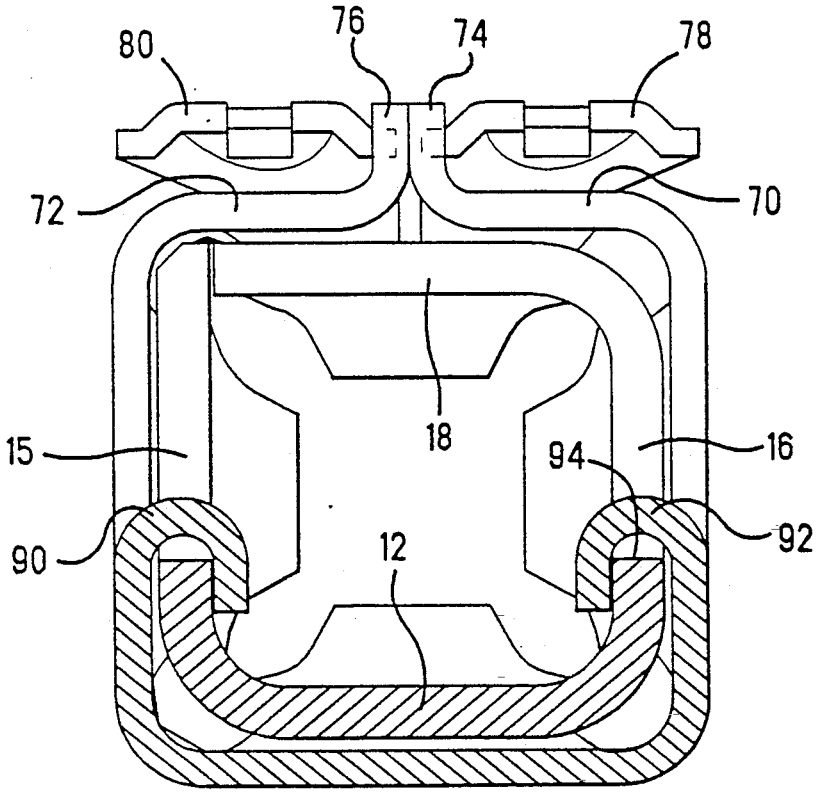
FIG. 5 is a cross-sectional view through lines 5—5 of FIG. 1.

As shown best in FIG. 3, the inner terminal includes a lower base section 12 which runs the substantial length of the terminal having a hinge section at 14 which carries the wire connection section 6. In the preferred embodiment of the invention the wire connecting section 6 is shown as an insulation displacement type slot, although a wire terminating section such as an F-crimp or similar connection could also be incorporated. Two side walls 15 and 16 upstanding from the base portion 12, as best shown in FIG. 5. As also shown in FIG. 5, a top wall portion 18 extends from the side wall portion 16 and is bent at a right angle relative to the side wall portion to form a substantially closed box. Each of the wall portions 12, and 15–18 extend forwardly and are constricted at 20 to form contact sections 22–28 respectively.

Figure 2:
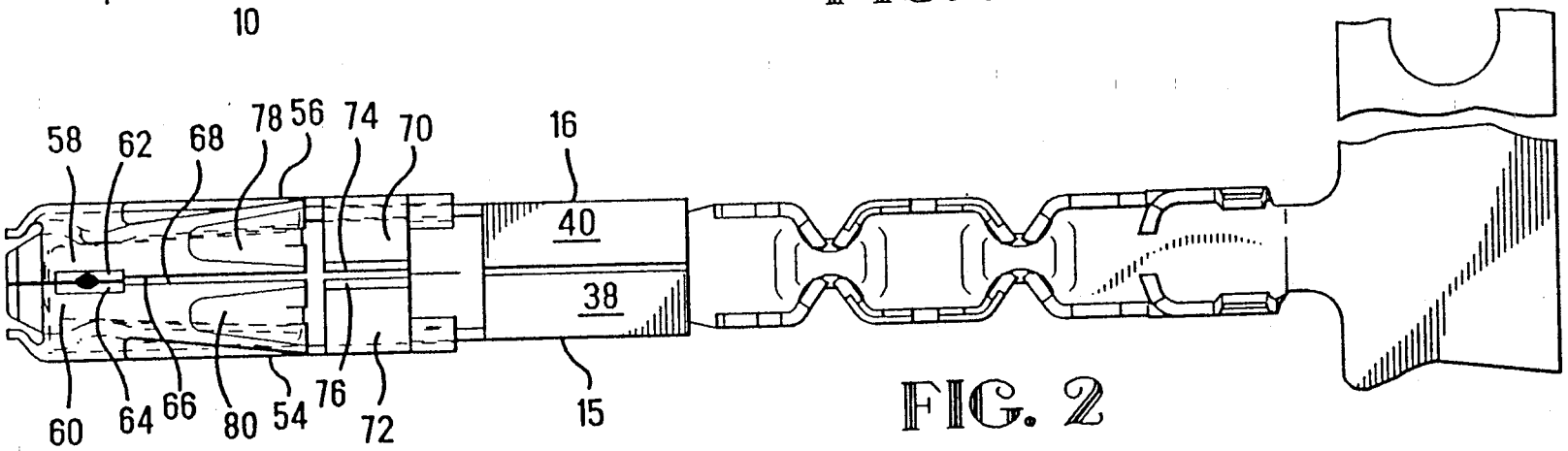
FIG. 2 is a top view of the terminal shown in FIG. 1.
Figure 6:
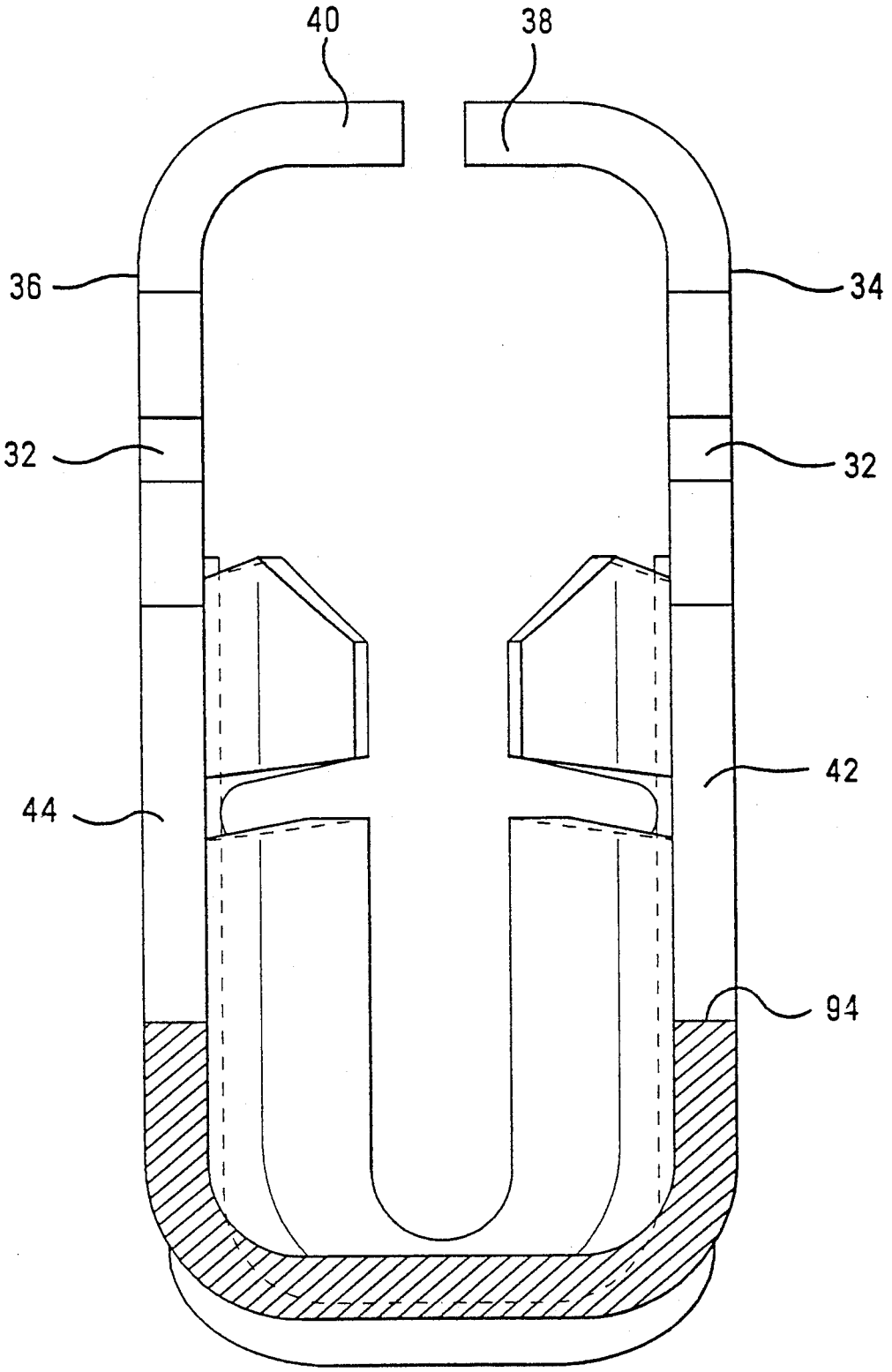
FIG. 6 is a cross-sectional view through lines 6—6 of FIG. 1.

A wire receiving slot section is shown at 30 which is profiled to receive a suppression device in the slot 32. This section 30 is profiled by upstanding wall sections 34 and 36 extending upwardly integral with respective wall sections 15 and 16. This section 30 also includes top cover portions 38 and 40, extending from respective extended wall portions 34 and 36 as best shown in FIGS. 2 and 6. Along the front edges 42 and 44 of respective wall portions 34 and 36 are located lead-in openings 48 for the slots 32.

Figure 4:
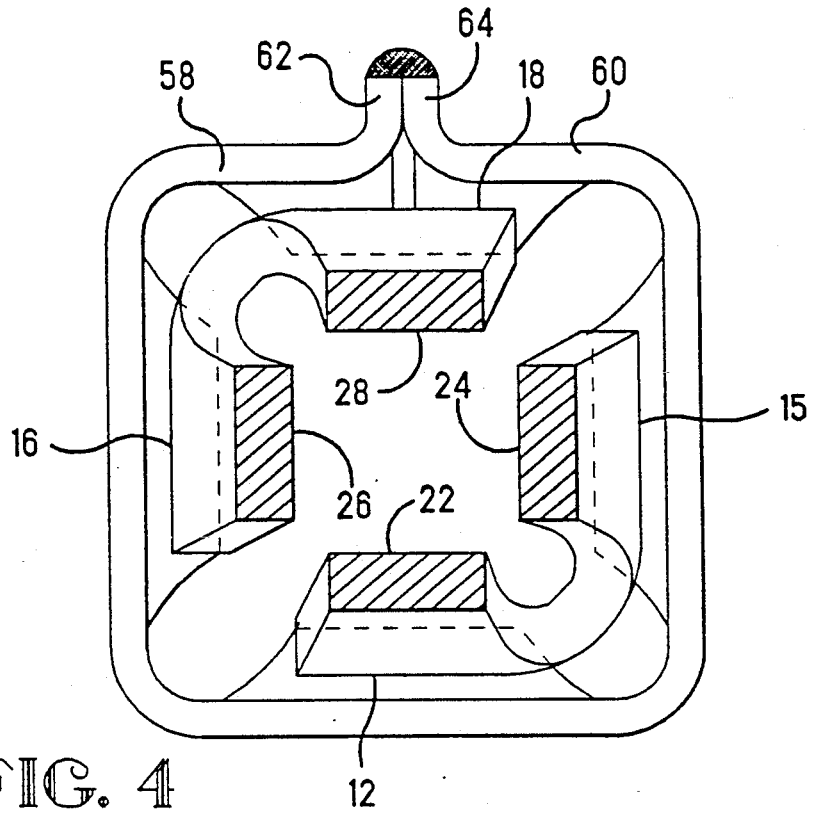
FIG. 4 is a cross-sectional view through lines 4—4 of FIG. 1.

With respect now to FIGS. 1 and 2, the outer spring 10 will be described in greater detail. The outer spring 10 comprises a lower base portion at 52 which lies substantially adjacent to lower base 12 of the inner contact portion and has side wall portions 54 and 56 which lie substantially adjacent to respective side wall portions 15 and 16 of the inner contact. The outer spring member 10 further includes top wall portions 58 and 60 (FIG. 2) adjacent to the front end of the terminal which are folded over to lie substantially adjacent to the top wall portion 18 of the inner contact. These top wall cover portions 58 and 60 include integral tabs 62 and 64 which extend from longitudinal seams 66 and 68, respectively. These tab portions 62 and 64 extend upwardly as shown in FIGS. 1 and 4 and are either welded or soldered together to fix the top wall portions 58 and 60 to hold them in a closed condition.

The outer spring member 10 further includes rear top wall portions 70 and 72 which further include upstanding tab portions at 74 and 76. The top wall sections 78 and 80 which are intermediate the top wall portions 58, 70; 60 and 72 respectively are separated from the side walls and along a rear edge thereby forming two discrete rearwardly facing locking lances, as best shown in FIGS. 2 and 5. As best shown in FIG. 5, the tab portions 62 and 64 define a central polarizing rib where the locking lances 78 and 80 are positioned on opposite sides of the rib (FIG. 2). The outer spring is also held to the contact member by way of tab portions 90 and 92 being clinched to the side walls 15 and 16 over an edge 94 formed in an opening 96 (FIGS. 3 and 5).

I claim:

1. An electrical terminal comprising a mating contact portion and a wire terminating rear section, and an outer spring in surrounding relation to said mating contact section, said terminal being characterized in that said outer spring is box shaped including a base wall, two sidewalls and top wall portions folded over to form a longitudinal seam, said top wall portions including at least one upstanding tab extending from opposite sides of said seam in abutting relation and fixed to each other, thereby forming a central polarizing rib.

2. The terminal according to claim 1 characterized in that said front tab portions on said outer spring are soldered or welded together.

3. The terminal of claim 1, characterized in that said top wall portions are formed towards a front end of said outer spring and at the rear end of said outer spring, each top wall portion including further upstanding tab portions folded against each other.

4. The terminal of claim 3, characterized in that the top wall portions intermediate said front and rear tab portions are separated along a side edge and rear edge, to form two discrete locking lances having a longitudinal seam therebetween.

* * * * *